US007481505B2

(12) United States Patent
Orita

(10) Patent No.: US 7,481,505 B2
(45) Date of Patent: Jan. 27, 2009

(54) INTAKE UNIT

(75) Inventor: Nobutoshi Orita, Itabashi Ward (JP)

(73) Assignee: Tok Bearing Co., Ltd., Tokyo (JP)

( * ) Notice: Subject to any disclaimer, the term of this patent is extended or adjusted under 35 U.S.C. 154(b) by 261 days.

(21) Appl. No.: 11/590,869

(22) Filed: Nov. 1, 2006

(65) Prior Publication Data

US 2007/0114896 A1 May 24, 2007

(30) Foreign Application Priority Data

Nov. 21, 2005 (JP) ..... 2005-335978
Sep. 20, 2006 (JP) ..... 2006-253784

(51) Int. Cl.
*A47B 88/00* (2006.01)

(52) U.S. Cl. ..... 312/333

(58) Field of Classification Search ..... 312/333, 312/334.44, 334.46, 334.27, 319.1, 334.7, 312/334.1, 334.14; 384/21, 19
See application file for complete search history.

(56) References Cited

U.S. PATENT DOCUMENTS 5,302,016 A * 4/1994 Lautenschlager et al. ... 312/333
6,736,471 B2 * 5/2004 Lin ..... 312/333
6,846,053 B2 * 1/2005 Salice ..... 312/334.14
6,848,759 B2 * 2/2005 Doornbos et al. ..... 312/319.1
6,910,557 B2 * 6/2005 Doornbos et al. ..... 188/290
7,028,370 B2 * 4/2006 Hoshide et al. ..... 16/96 R
7,240,978 B2 * 7/2007 Kobayashi et al. ..... 312/333
7,244,005 B1 * 7/2007 Lu ..... 312/333
7,374,260 B2 * 5/2008 Lu ..... 312/333
2006/0016279 A1 * 1/2006 Sato et al. ..... 74/89.17

* cited by examiner

*Primary Examiner*—Janet M Wilkens
(74) *Attorney, Agent, or Firm*—Wenderoth, Lind & Ponack, L.L.P.

(57) ABSTRACT

It is an object to decrease the size of the intake unit and to increase possibility of incorporating this intake unit to the existing drawer, sliding door, and so on. The intake unit engaging with a projection portion of the drawing device to move a drawer in the predetermined direction comprises a basic substrate; a cylindrical shock absorber; a movement member releasably engaged at one end of movement stroke; a pulley supported on the side of movement of the cylindrical shock absorber; and a flexible member in which a middle portion thereof is suspended to the pulley, one end is connected to said movement member, and the other end is connected to said basic substrate. When the movement member is released from the lock state, said movement member moves by predetermined stroke in one direction due to urging force of the urging member, and against this movement, a brake of said cylindrical shock absorber is applied through said flexible member.

6 Claims, 17 Drawing Sheets

A – A

INTAKE UNIT

BACKGROUND OF THE INVENTION

The present invention relates to an intake unit used for a drawing device such as a drawer, sliding unit, and so on.

The intake unit to be used for a conventional drawing device such as a drawer, sliding unit, and so on has employed a structure to let a long-sized rack gear be engaged with a pinion gear to control the rotation of the above-mentioned pinion gear by a rotary damper mechanism.

If employing a structure to use a rack gear and pinion gear to convert to a rotary movement from a linear movement of a movement member movably supported to a basic substrate of a drawing device, there are following two methods. One is a method in which the long-sized rack gear 22 is attached to the side of the movement member 2, the rotary damper 4 is attached to the fixed side (basic substrate 12) to let the gearwheel 20 provided on the rotary portion of the rotary damper 4 be engaged with the tooth portion of the above-mentioned rack gear 22 as shown in FIGS. 17 and 18. The other is a method to attach the long-sized rack gear to the fixed side (basic substrate side), and attach the rotary damper to the movement member to let the gearwheel provided on the rotary portion of the rotary damper be engaged with the tooth of the above-mentioned rack gear. (for example, refer to Japanese Published Unexamined Patent Application No. H5-317133).

FIGS. 17 and 18, and FIGS. 19 and 20 show a conventional device which employed the second method.

In FIG. 17, the reference numeral 2 is a movement member 2, numeral 4 is a rotary damper mounted on the movement member, numeral 12 is a basic substrate, numerals 14 and 16 are support blocks to fix the basic substrate 12 to the drawer of drawing device or the bottom plate of the external box and numeral 18 is a coil spring movably supported by the basic substrate 12 to urge the movement member 2 toward the opposite support block 14 in the longitudinal direction of the basic substrate 12. On the rotary side of the rotary damper 4 whose axis side was fixed to the movement member 2, the gearwheel 20 is securely installed and the foregoing gearwheel 20 is engaged with the rack gear 22 on the basic substrate 12. Numeral 24 is a slider movably supporting the engagement member 26 formed with the first and second engagement portions 8 and 10, and is slidably attached to the basic the basic substrate 12 and connected to the movement member 2. In FIG. 19, numeral 28 is a holding body which is securely installed in the gearwheel 20 and supports the engagement member 26 at the right angle to the mounted position of the rotary damper 4 in the movement direction of the movement member 2 of the unit. The structure other than mentioned above is the same as that of the conventional device shown in FIG. 17.

In the structure of above-mentioned conventional device, when the drawer is pulled out from the external box, the movement member 2 is moved to the right end of the basic substrate 12 in the drawing against the springing force of the spring 18 and is locked in the foregoing position with a locking means (not illustrated). If pushing the drawer toward the back of the external box by hand from the condition in which the drawer is pulled out from the external box, the projection portion 6 is engaged with the 1st engagement portion 8, the pressing force to the first engagement portion 8 of the projection portion 6 releases the locked conditions to the movement member 2, and the movement member 2 is moved leftward by the springing force of the spring 18 along the basic substrate 12 in the drawing. At this time, the projection portion 6 is engaged with the second engagement portion 10 to transfer the movement force on the movement member 2 side by the springing force of the spring 18 to the drawer, which is pulled in toward the back side of the external box by the springing force. For the movement of the movement member 2 by the springing force of the spring 18 along the basic substrate 12, the braking force by the rotation damper 4 is applied to the movement of the movement member 2, which causes the drawer to be slowly pulled in toward the back side without quick action.

If the first method is employed, since the movement member 2 is moved with the long-sized rack gear 22 mounted as shown in FIG. 16, the intake unit becomes extremely long-sized along the movement direction of the above-mentioned movement direction to have to be large-sized.

Meanwhile, if the second method is employed, the movement member 2 will move with the rotary damper 4 mounted on the movement route formed with the basic substrate 12 as shown in FIGS. 17 and 19. In this case, in this movement member 2, the movement member 2 needs to be provided with the first engagement portion 8 which can be engaged with the projection portion 6 in one movement route, which is provided in the above movement member 2 as protruding in the movement route for the projection portion 6 provided in the pulled-in member, and second engagement portion 10 which can be engaged in movement routes in other directions. Depending on the position where the rotary damper 4 is mounted on the movement member 2, as the conventional device shown in FIG. 16, the above-mentioned first engagement portion 8 and the second engagement portion 10 have to be placed as protruding at the right angle (width direction) to the above-mentioned rotary damper 4 mounting position and the movement direction of the above-mentioned movement member 2, and/or in the movement direction X of the above-mentioned movement member 2, or at the right angle Y (thickness direction) to the above-mentioned movement member 2 as shown in FIGS. 19 and 20.

If the above-mentioned first engagement portion 8 and second engagement portion 10 are placed at the right angled (width direction) to the above-mentioned rotary type damper mounted position and the above-mentioned movement member 2 movement direction, the direction, that is the size in the width direction of the intake device becomes larger, causing the entire device size to be larger in the result. In addition, if the above-mentioned first engagement portion 8 and second engagement portion 10 are placed at the right angle (Y) (thickness direction) to the above-mentioned rotary damper 4 mounted position, a space needs to be provided in the thickness direction. In addition, particularly if the above-mentioned first engagement portion and second engagement portion are placed at the right angle (d) (width direction) to the above-mentioned rotary damper mounted position and the movement direction of the above-mentioned movement member, or if placed at the right angle (Y) of the device (thickness direction), the device will occupy a space throughout a range of movement.

After all, either in the first method or second method, if the structure using a rack gear and a pinion gear is employed, a space to be occupied by the intake unit will become larger and the size of the intake unit has to be large-sized entirely.

In case that this intake device is assembled and produced from the design stage of a drawing device such a drawer, sliding door, and so on, even if a space to be occupied by the intake device is larger, design can be performed and such a big problem will not be arisen. However, if attaching an intake unit to a drawer, sliding door, and so on which were already completed, that is, if an intake device is regarded as a unit itself, a space where an intake device unit is placed in the completed drawer, sliding door, and so on is limited, and there are many cases of insufficient placement space for an intake device. In these cases, it is impossible even to assemble an intake device unit.

The present invention has an object to miniaturize the intake unit as much as possible and to greatly increase the possibility to assemble it into a ready-made drawer, sliding door, and so on in order to solve the above-mentioned problems.

SUMMARY OF THE INVENTION

An intake unit engaging with a projection portion of a drawing device to move a drawer in the predetermined direction, comprises:

a basic substrate;

a cylindrical shock absorber;

a movement member;

a movement member guide mechanism provided to foregoing basic substrate for movably and linearly guiding foregoing movement member along foregoing basic substrate within a scope of predetermined stroke;

an urging means provided on foregoing basic substrate side for urging foregoing movement member in one direction;

a first engagement portion provided in foregoing movement member for engaging with foregoing projection portion when foregoing projection portion moves relatively to foregoing movement member in one direction;

a second engagement portion provided in foregoing movement member for engaging foregoing projection portion when foregoing projection portion moves relatively to foregoing movement member in the other direction;

an locking means which releasably locks movement of foregoing movement member at the end of movement of foregoing movement member resisting an urging force of foregoing urging means and which releases this lock by pressure due to one direction relative movement of foregoing projection portion with respect to foregoing first engagement portion; and a pulley which is supported to the foregoing movement side as interlocking with the movement side of the shock absorber of the foregoing cylindrical shock absorber; and a flexible member in which a middle portion is engaged with the foregoing pulley and one end is connected to the foregoing movement member and the other end is connected to the foregoing basic substrate.

The foregoing cylindrical shock absorber has a structure of applying a braking force to a telescopic relative movement between a cylinder and a piston rod, one end of which is a movable side and other end is a fixed side, the cylindrical shock absorber being attached to foregoing basic substrate on the fixed side. The foregoing movement member is released from the lock state, said movement member moves by predetermined stroke in one direction due to urging force of said urging means, and against this movement, a braking force of said cylindrical shock absorber is applied through said flexible member It is preferable that the foregoing cylindrical shock absorber comprises an initial position returning means pushing the piston rod outward from the cylinder.

It is preferable that the foregoing urging means is a coil spring which is connected to said movement member at one end thereof and connected to said basic substrate at the other end thereof, and which changes direction by a direction change mechanism in the middle thereof.

It is preferable that the foregoing cylindrical shock absorber which comprises: a cylinder filled with oil; a piston formed with a bore for passing through the oil substantially without resistance; a piston rod connected to foregoing piston; a valve opening foregoing bore when foregoing piston moves in one direction inside foregoing cylinder and closing foregoing bore when foregoing piston moves in other direction; and a coil spring disposed between a back end of foregoing cylinder and a spring receiver attached to foregoing piston rod, wherein foregoing coil spring comprises an initial position returning means pushing the piston rod outward from the cylinder.

The present invention enables an intake device unit to be miniaturized and to greatly increase the possibility to assemble it into a ready-made drawer, sliding door, and so on than before by composing the system as above mentioned.

DETAILED DESCRIPTION OF THE INVENTION

Embodiments according to the invention are hereinafter described with reference to the accompanying drawings.

Figure 1:
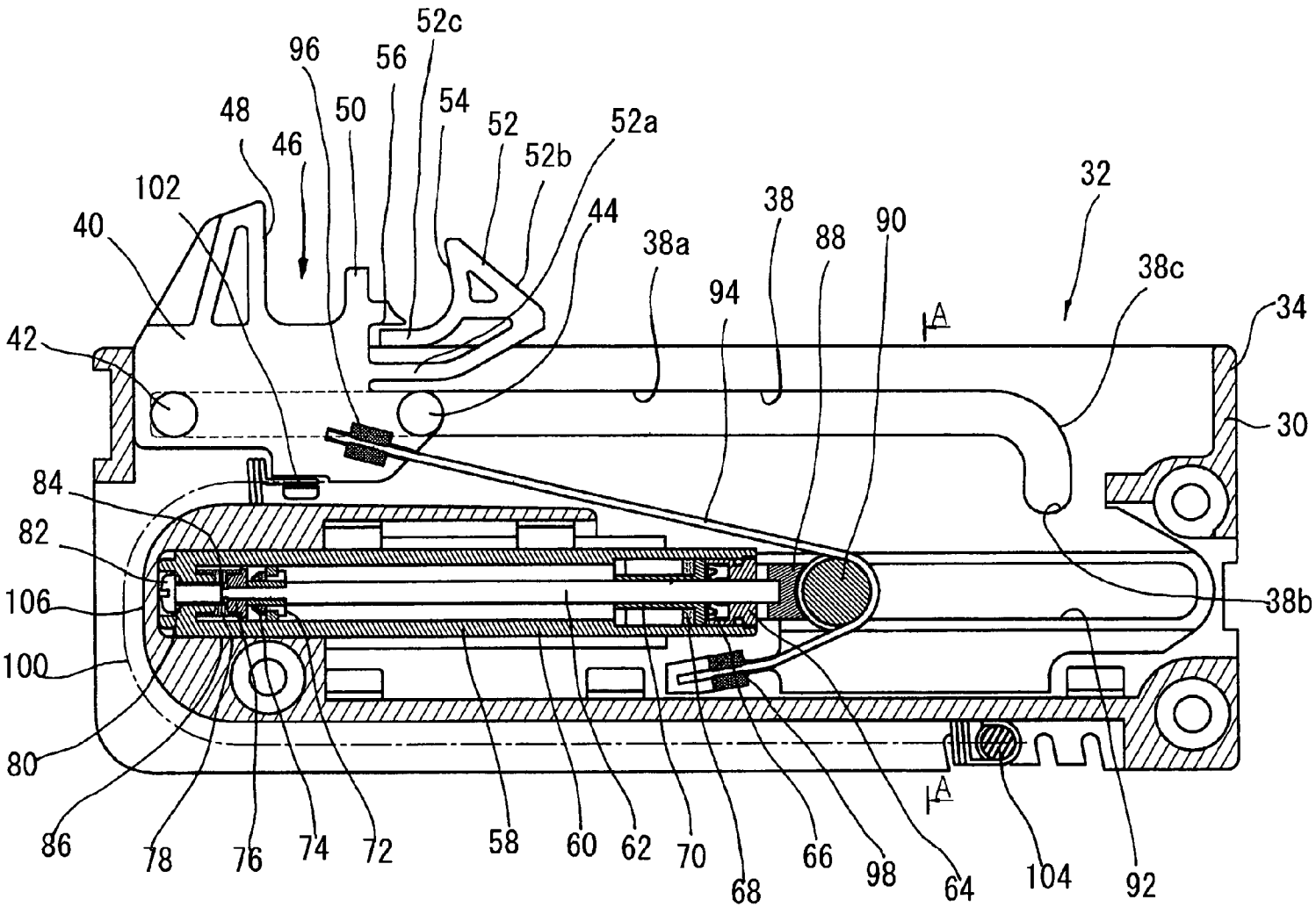
FIG. 1 is an elevational graphical view showing an intake unit according to the present invention.
Figure 2:
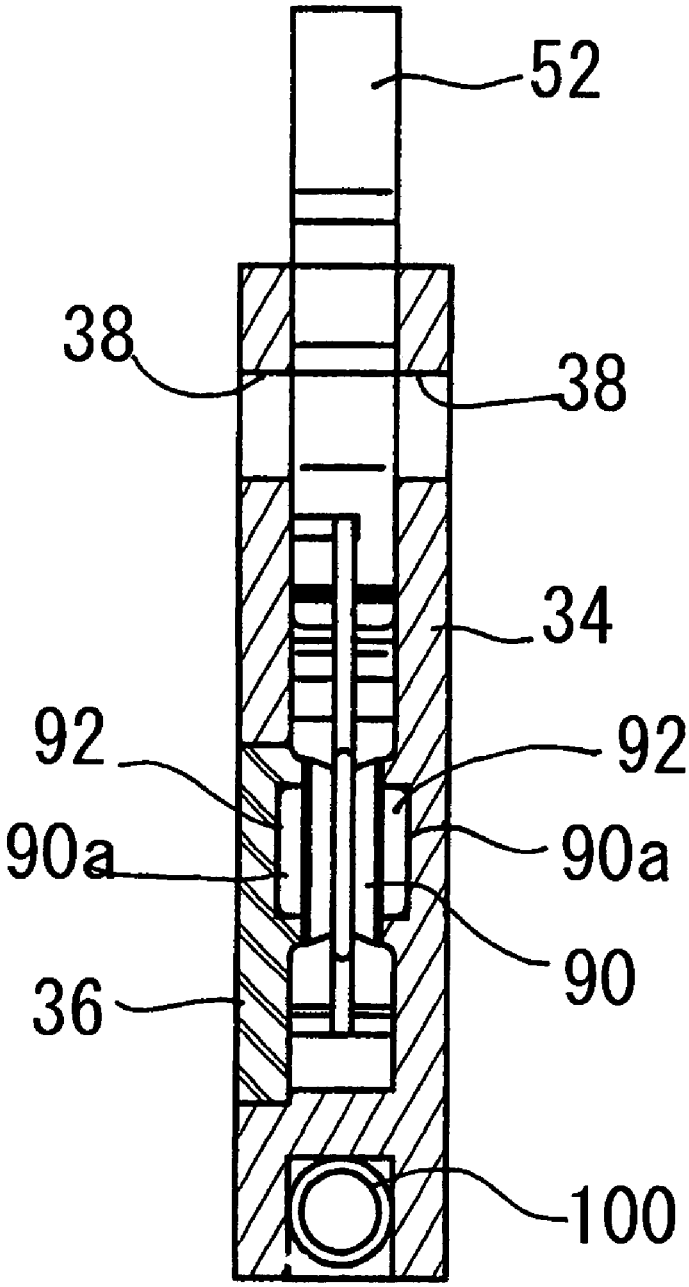
FIG. 2 is an A-A line sectional view showing an intake unit.
Figure 3:
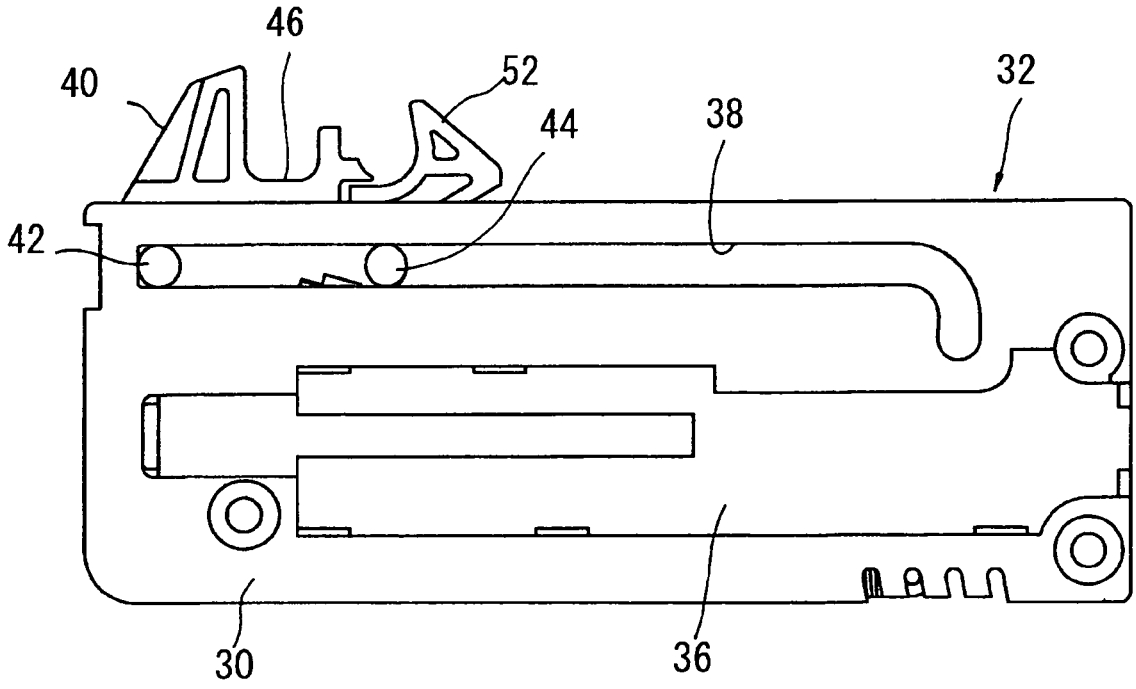
FIG. 3 is an elevational view showing an intake unit.
Figure 4:
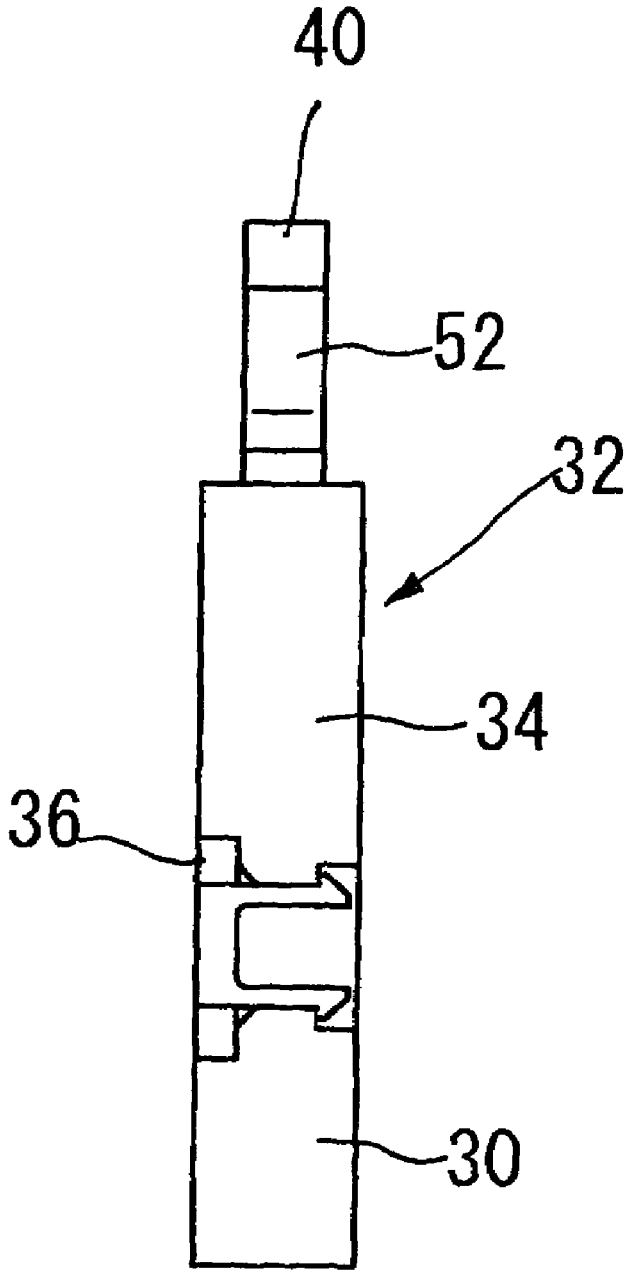
FIG. 4 is a right-side elevational view showing an intake unit.
Figure 5:
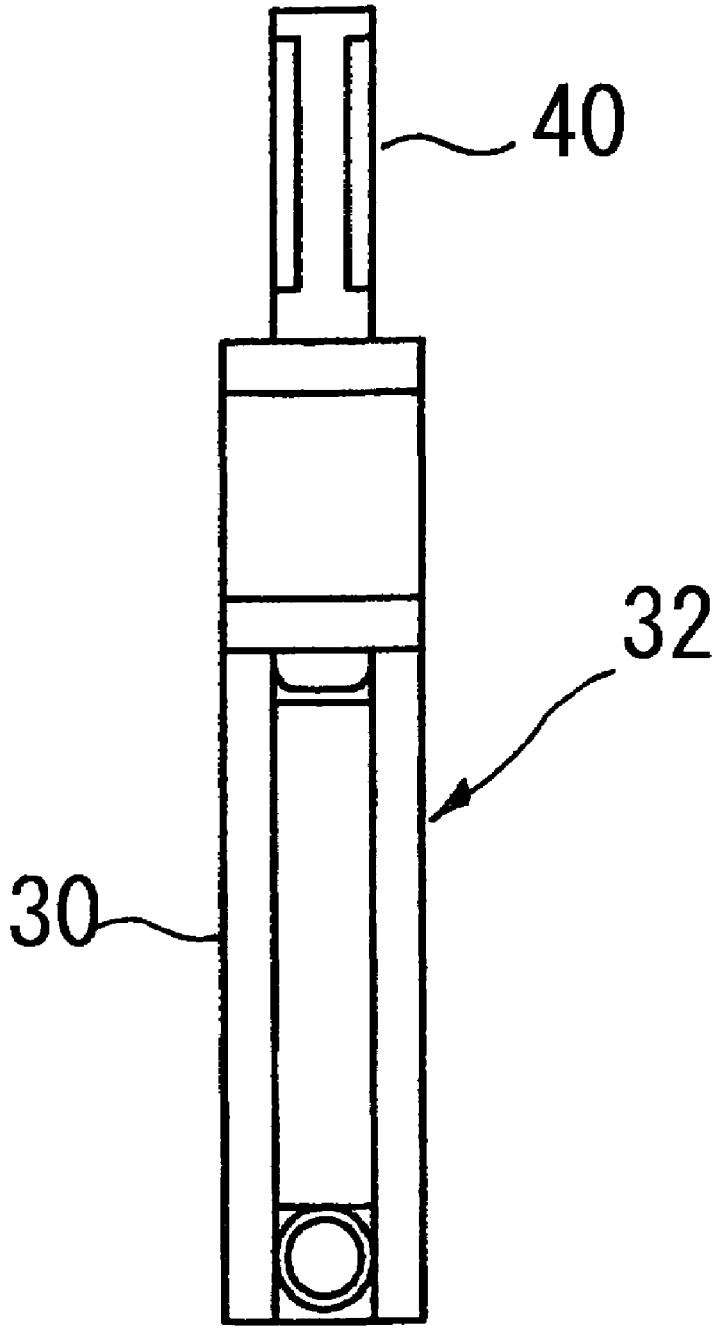
FIG. 5 is a left-side side elevational view showing an intake unit.
Figure 6:
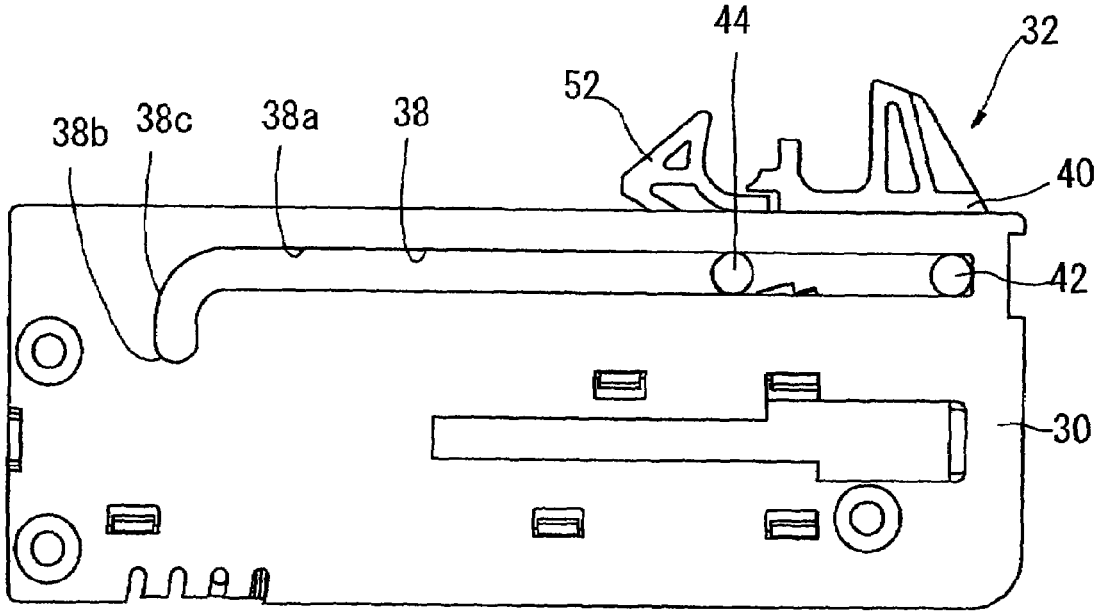
FIG. 6 is a rear elevational view showing an intake unit.
Figure 7:
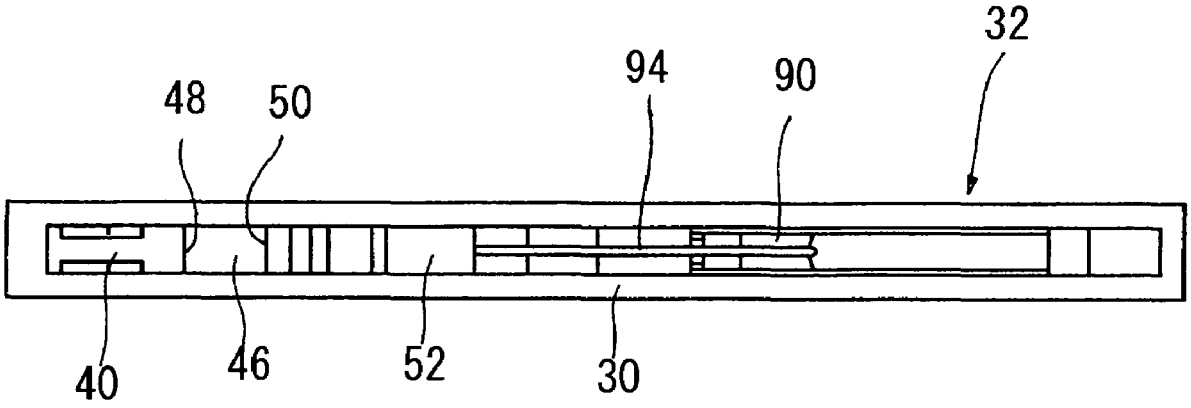
FIG. 7 is a plan view showing an intake unit.
Figure 8:
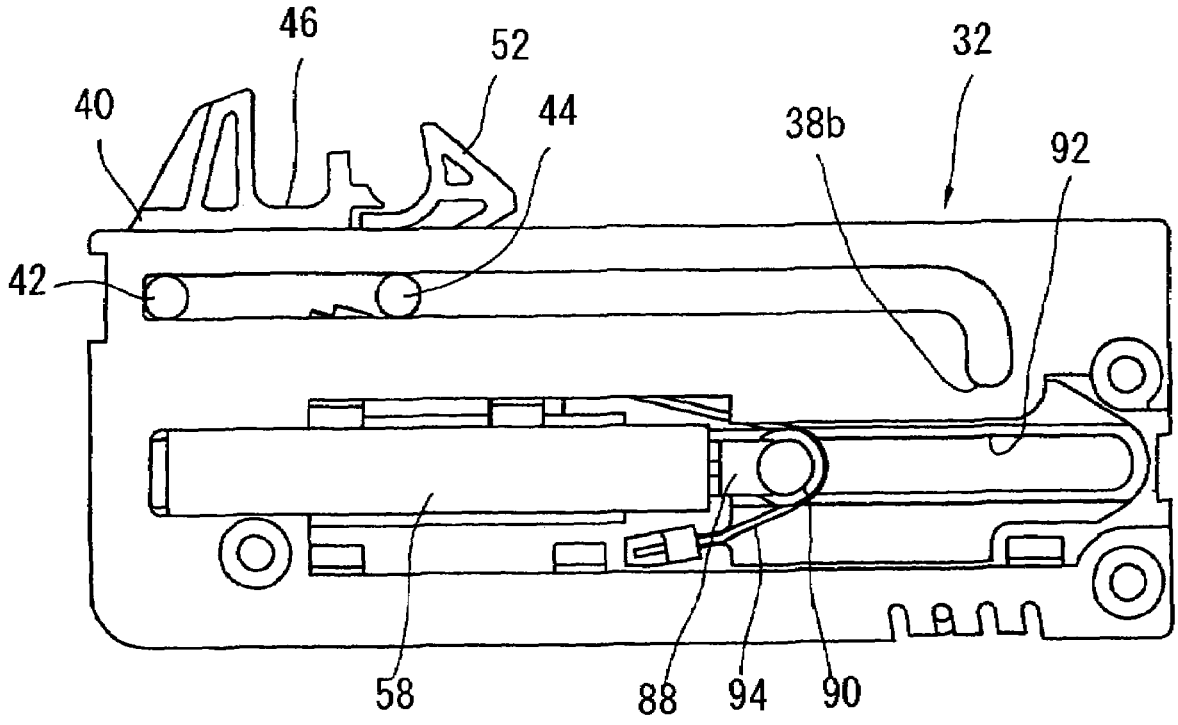
FIG. 8 is a elevational view showing an intake unit whose cover is removed.
Figure 9:
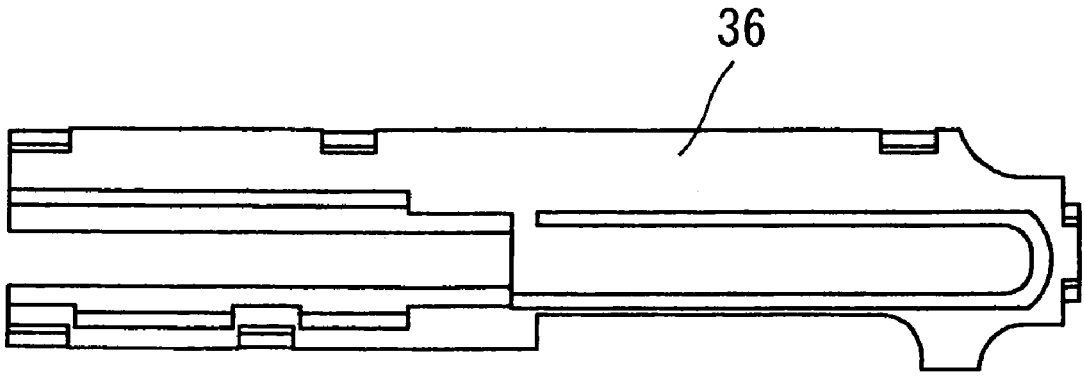
FIG. 9 is a rear elevational view showing a cover.
Figure 10:
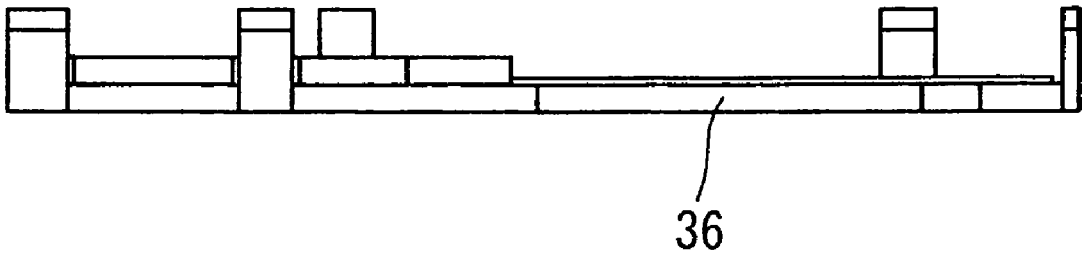
FIG. 10 is a bottom plan view showing a cover.

In FIG. 1, numeral 30 is a basic substrate of an intake unit 32 according to the present invention and serves as a casing. The foregoing basic substrate 30 is a resin molded product and comprises a main body 34 and a cover 36 fixed to some part of an opening thereof as shown in FIG. 2 and FIG. 3. In a storage space of the foregoing basic substrate, an intake composition element described below is stored and placed, and the foregoing substrate 30 and these composition elements are entirely simplified (unified) as an intake unit. The both-side wall portions of the foregoing basic substrate 30 is formed with a groove 38. The foregoing groove 38 is equipped with a linear portion 38*a* extended in the longitudinal direction of the basic substrate 30, locking portion 38*b* which is semi-perpendicular to the above 38*a* and a curved portion 38*c* formed in a connection portion between the foregoing locking portion 38*b* and the linear portion 38*a*. Numeral 40 is a resin-made movement member, which is protruded by axial convex fitting portions 42 and 44 which are extended horizontally being located around the forging member in a predetermined interval with each other. The foregoing fitting convex portions 42 and 44 are slidably fitted into the foregoing groove 38. The foregoing movement member 40 is in a unified manner formed with a U-shaped chuck portion 46. Around the foregoing chuck portion 46, a first engagement portion 48 and a second engagement portion 50 are formed with a predetermined interval.

In addition, the foregoing movement member 40 is in a unified manner formed with an emergent-use engagement member 52, which is in a unified manner connected to the movement member 40 through an elongated spring portion 52. The foregoing emergent-use engagement member 52 is formed with a 3rd engagement portion adjacent to an inclined plate 52*b*. In addition, the foregoing engagement member 52 is in unified manner formed with a projected piece 52*c* for locking and the end of the projected piece 52*c* for locking has a little space and faces to a stopper 56 formed in the movement member 40.

Numeral 58 is cylindrical shock absorber and incorporates a resisting means in a cylinder 60 for a case to apply a braking force to a relative movement along the linear direction of a piston rod 62 and the cylinder 60. According to the present embodiment, an oil-type shock absorber with the cylinder 60 filled with oil is employed but not to limited to a shock absorber illustrated, and if a composition can apply a predetermined braking force to a relative movement in one-way direction or reciprocating (2-way) direction along the linear direction between the cylinder 60 and the piston rod 62, it is preferable to compose whatever instead of the shock absorber illustrated.

The cylindrical shock absorber 58 according to the present embodiment as shown in FIG. 1, comprises a cap 64, a seal 66 for rod, an accumulator 68 composed of a sponge and a foamed rubber to adjust the capacity in the cylinder 58, an accumulator holder 70, a piston 72, a valve 74 to open/close a through-hole of the piston 72, a spring holder 76, a coil spring 78 for rod recovery, a rear-end-side seal 80, a rear-end lid 82, a pulling-prevention stopper 84 for piston rod, and so on. When the cylindrical shock absorber 58 is moved leftward from the original position which the piston 62 protrudes uppermost rightward to the cylinder 58 in FIG. 1, the piston 72 which is secured to the piston rod 62 and interlocked with it, takes against the springing force of the coil spring 78 and moves leftward in the cylinder 58.

At this time, since the piston 72 is moved leftward in the cylinder 58 with the through-hole clogged with the valve 74, the piston 72 receives much more fluid pressure by oil passing over a little clearance (not illustrated) between the piston 72 and the cylinder 58. This fluid pressure affects much more braking force to the leftward movement to the cylinder 58 in FIG. 1. FIG. 1 shows a condition where the piston 62 is pressed into the cylinder 60 uppermost. Meanwhile, if the leftward pressing force to the piston rod 62 is released, the piston 72 is pressed rightward by the springing force of the coil spring 78 and is moved in a rightward recovery direction in the cylinder 58 by this pressure force in FIG. 1.

At this time, the piston 72 is moved backward along the piston 62 until the valve 76 is locked in the spring holder 76 by the oil pressure passing over the through hole of the piston 72 and is separated from the through-hole of the piston 72 and moved in the recovery direction without receiving much oil resistance due to the release of the through-hole, and is moved in the recovery direction by the springing force of the coil spring 78 in the cylinder 60 in FIG. 1. This prevents a large amount of braking force to being applied to the rightward recovery movement of the piston rod 62 in FIG. 1. The foregoing cylindrical shock absorber 58 is located sideways in the basic substrate 30 and is fitted and maintained to a holder portion 86 formed with one end of the cylinder 60 in the basic substrate 30. A rod cap 88 is secured to the end of the piston rod 62 of the cylindrical shock absorber 58 and this curved holding surface is rotatably supported by a pulley 90.

On a side wall of the foregoing basic substrate 30 and a inner wall of the cover 36, guide grooves 92, 92 extending in a linear direction in parallel with the linear portion 38*a* of the foregoing groove 38 is formed and a shaft portion 90*a* of the foregoing pulley 90 (refer to FIG. 2) and foregoing rod cap 88 are slidably fitted into the foregoing guide grooves 92, 92. An intermediate portion of a flexible member 94 composed of a wire is engaged with the V-shaped groove of the foregoing pulley 90 as making a U-turn around this pulley 90 as a standard, one end of the foregoing flexible member 94 is connected to the lower part of the foregoing movement member 40 through a wire fixing member 96 and the other end of the flexible member 94 is attached to the basic substrate 30 through the wire locking member 98.

Figure 15:
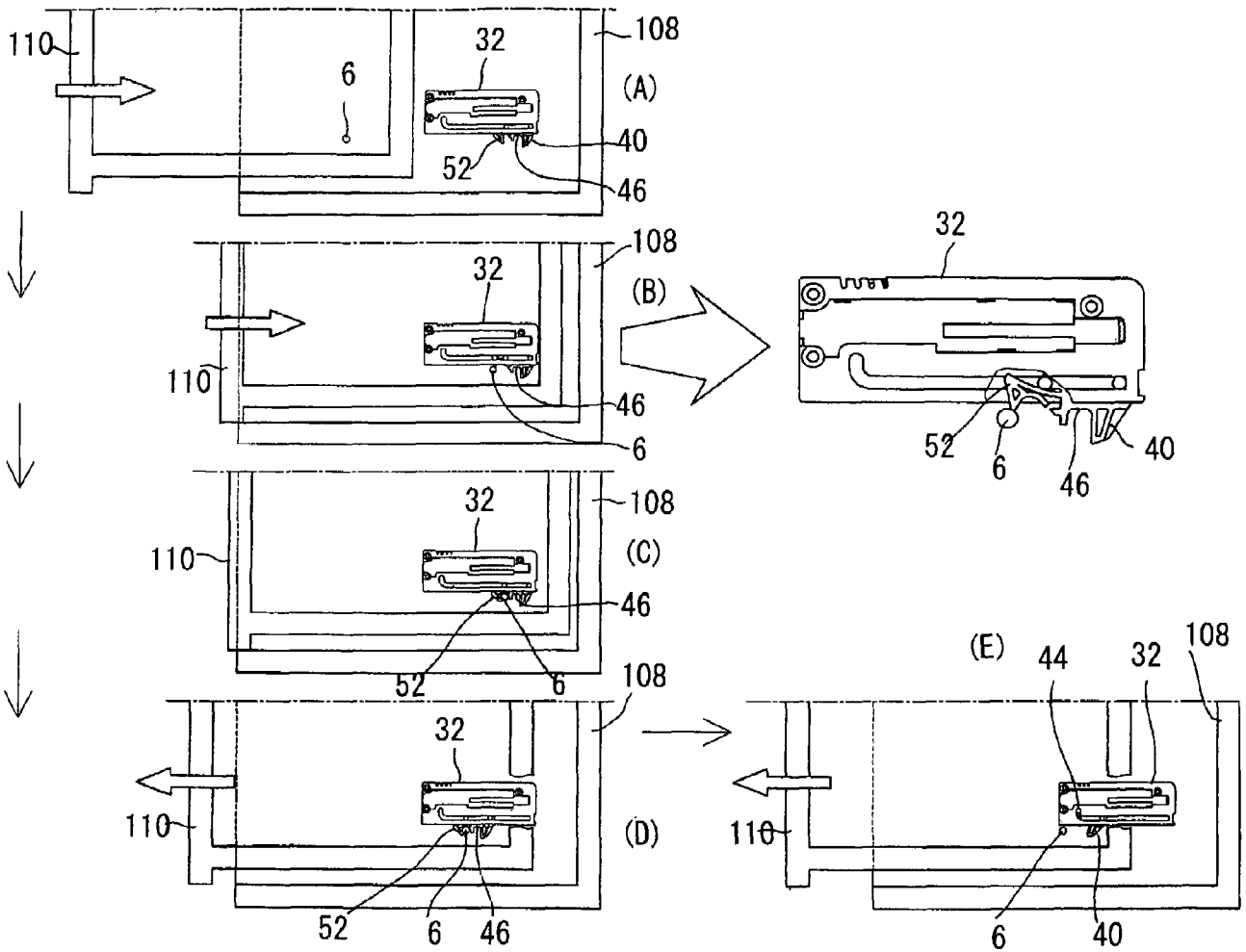
FIG. 15 is a sectional view showing examples other than the present invention.
Figure 16:
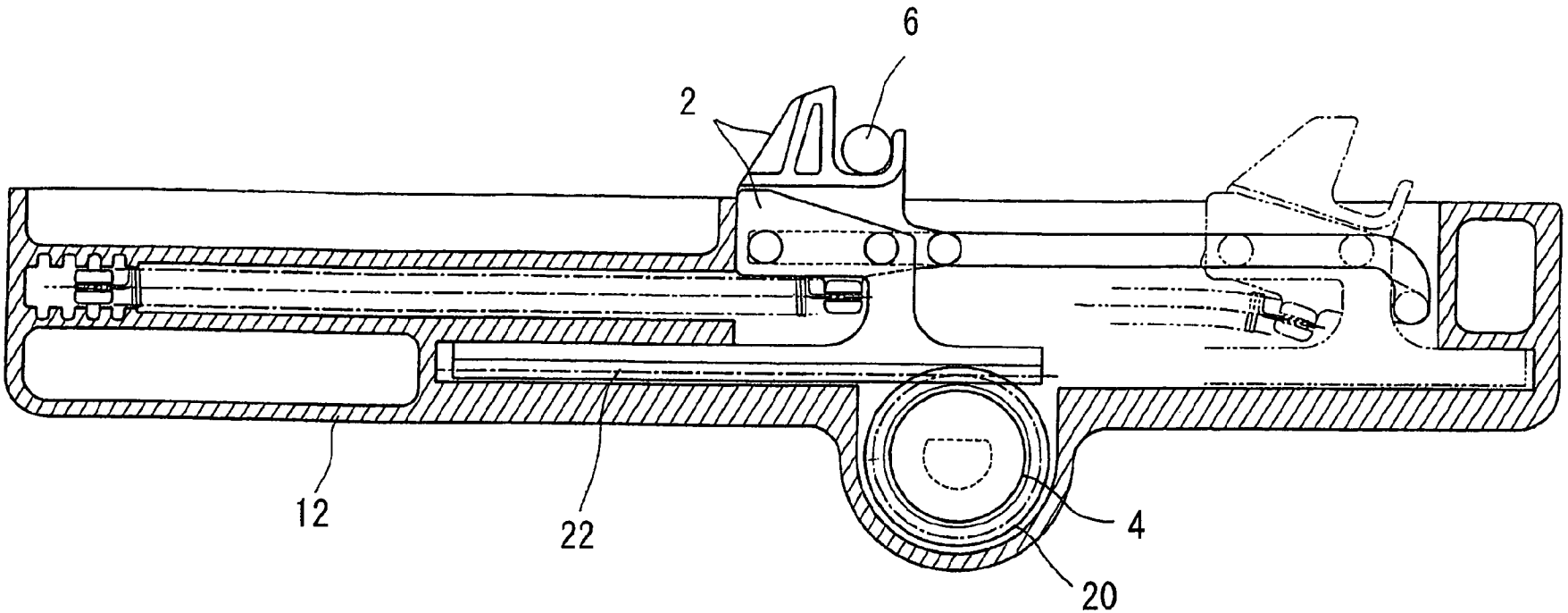
FIG. 16 (PRIOR ART)
FIG. 16 is an elevational graphical view according to a prior art.
Figure 17:
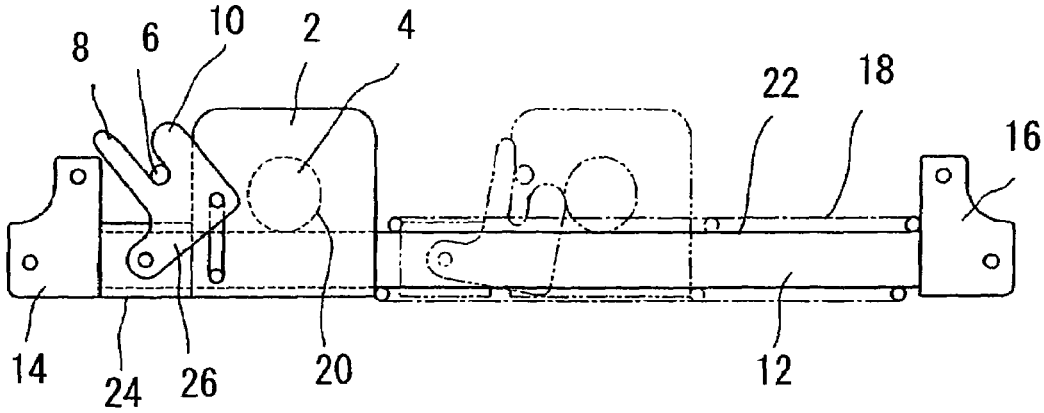
FIG. 17 (PRIOR ART)
FIG. 17 is an elevational graphical view according to a prior art.
Figure 18:
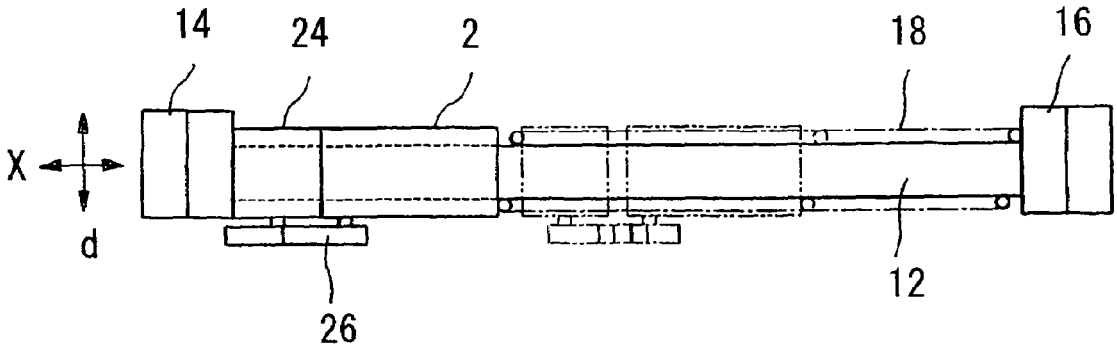
FIG. 18 (PRIOR ART)
FIG. 18 is plan graphical view according to a prior art.
Figure 19:
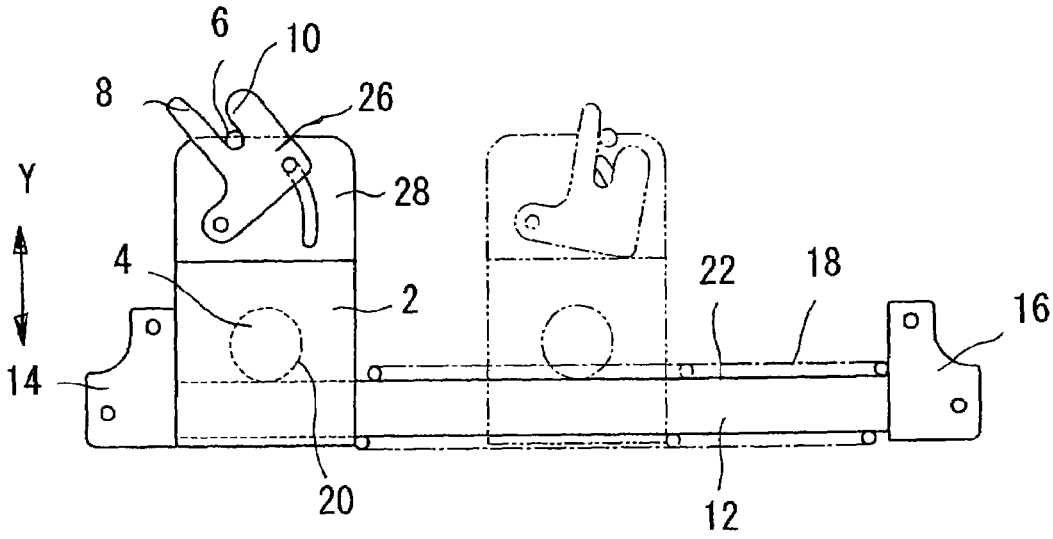
FIG. 19 (PRIOR ART)
FIG. 19 is an elevational graphical view according to a prior art.
Figure 20:
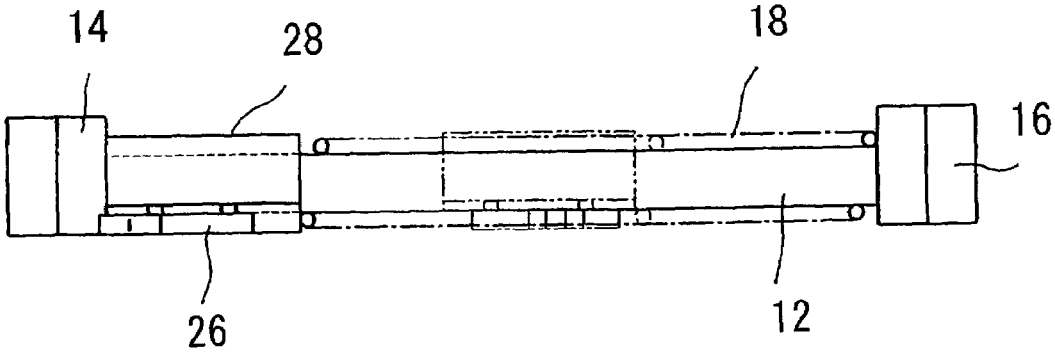
FIG. 20 (PRIOR ART)
FIG. 20 is plan graphical view according to a prior art.

The foregoing pulley 90 comprises a guide portion to guide the foregoing flexible member 94 in the U-turn direction. This guide portion at the movement side of the shock absorber 58 is not limited to the special composition of the pulley but can undergo various design changes. For example, as shown in FIG. 15, it is preferable that the movement side of the shock absorber 58 such as the piston rod 62, and so on is provided with a convex portion 89 having a curved surface in unified manner, the flexible portion 94 which is engaged with the curved surface of the foregoing convex portion 89, that is, and the guiding surface is moved in a U-turn direction while sliding on the guiding surface of the foregoing convex surface 89 to compose the foregoing convex section 89 as a guiding portion. In this case, it is preferable that the guide portion of the convex section 89 is provided with a restricting means such as guide grooves to prevent the misalignment in the detachment direction of the flexible member 94 from the foregoing guide surface. In addition, the compositions other than the intake unit shown in FIG. 15 are the same as those shown in FIG. 1.

Numeral 100 is an intake spring composed of a coil spring, one end thereof is connected to an fitting 102 formed in a lower portion of the movement member 40 and the other end thereof is position-adjustably connected to one side of the basic substrate through a fitting 104. The intermediate portion of the foregoing intake spring 100 is placed crookedly in a laid-down U-shaped manner by a direction change mechanism composing of a curved guide surface 106 formed in the basic substrate 30.

Next, an intake operation where an intake unit is attached to a drawing device is hereinafter described with reference to FIG. 11 through FIG. 13. In addition, FIG. 12 shows a drawing device viewing from overhead and FIG. 13 shows a drawing device viewing end-on. The conditions from (A) to (D) in FIG. 12 correspond to the conditions from (A) to (D) in FIG. 13.

In FIG. 12, numeral 108 is an external box (main body) of the drawing devices such as a drawer, sliding door, and so on, into which a drawer slidably fitted. The drawer 110 shows a movement body such as a drawer, sliding door, and so on.

The bottom plate of the drawer 110 is protruded by projection portion 6 composed of a pin. The basic substrate is secured to the bottom plate of the external box 108 as a chuck portion 46 of the foregoing movement member 40 is placed on a movement route of the foregoing projection portion 6 and the linear portion 38*a* of the groove portion 38 is in parallel with the movement direction of the drawer 110. It is preferable that the basic substrate 30 is attached to the drawer 110 side. In this case, the projection portion 6 is provided in the external box 108.

Figure 11:
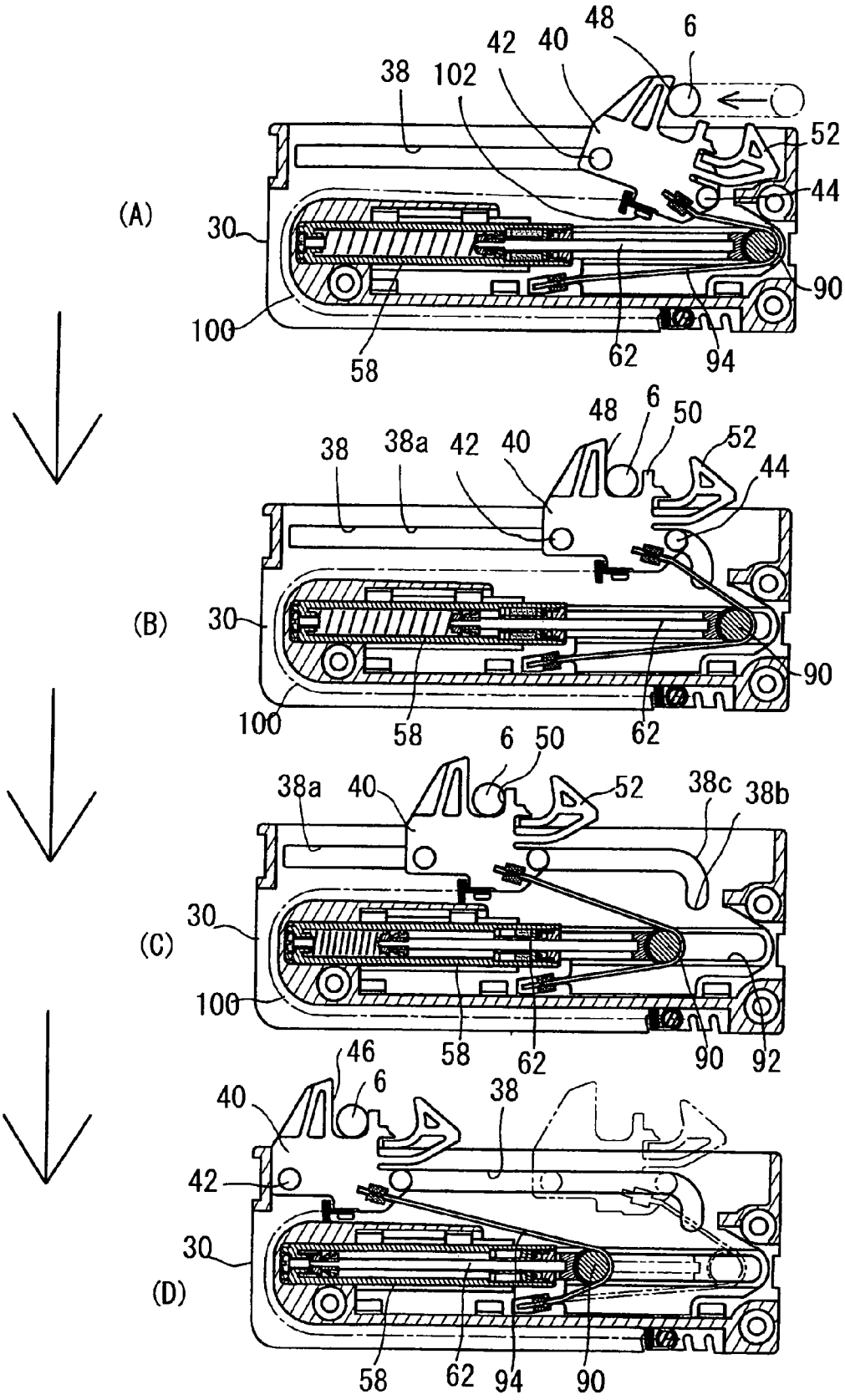
FIG. 11 is an operational graphical view according to the present invention.
Figure 12:
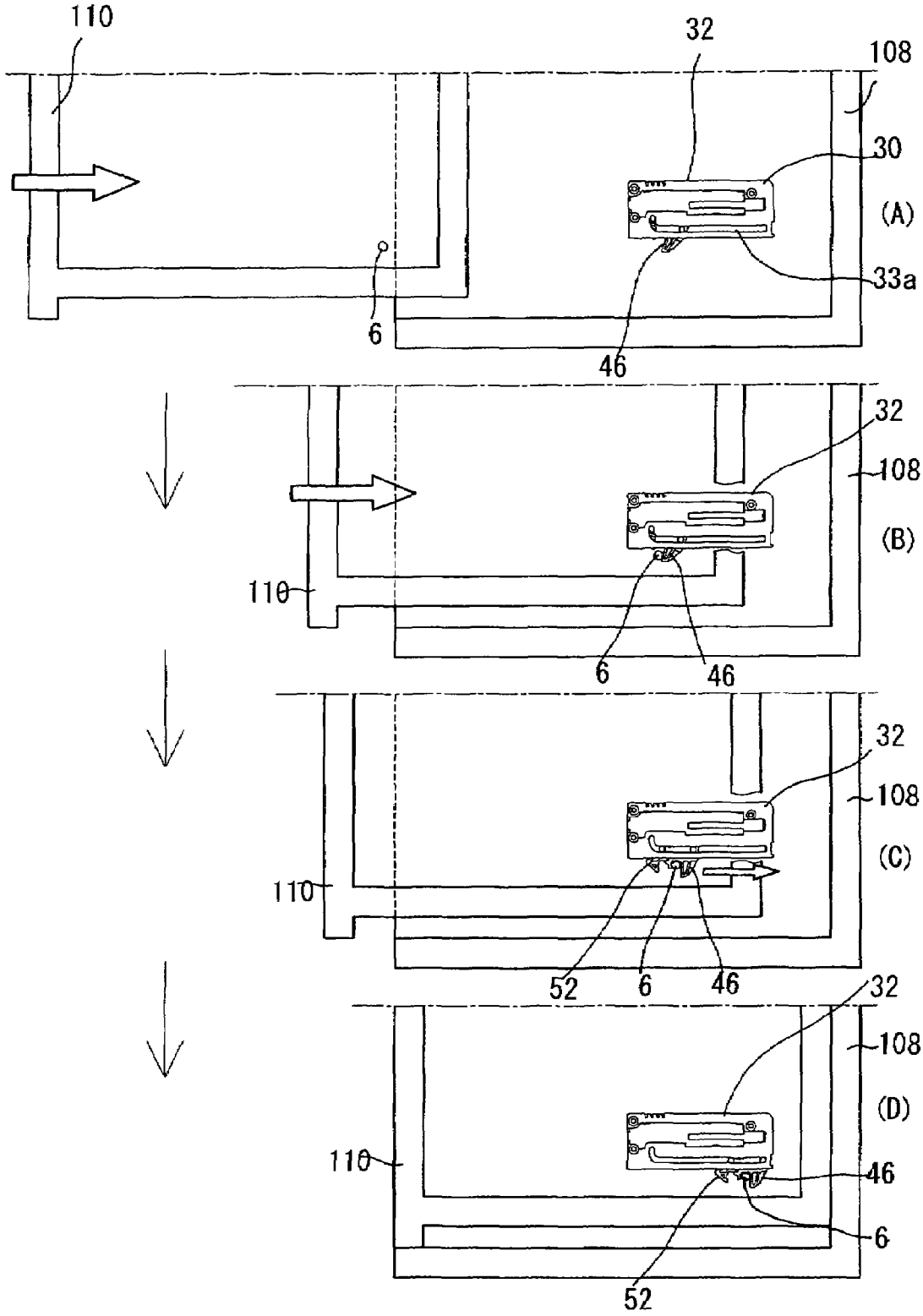
FIG. 12 is an operational graphical view according to the present invention.
Figure 13:
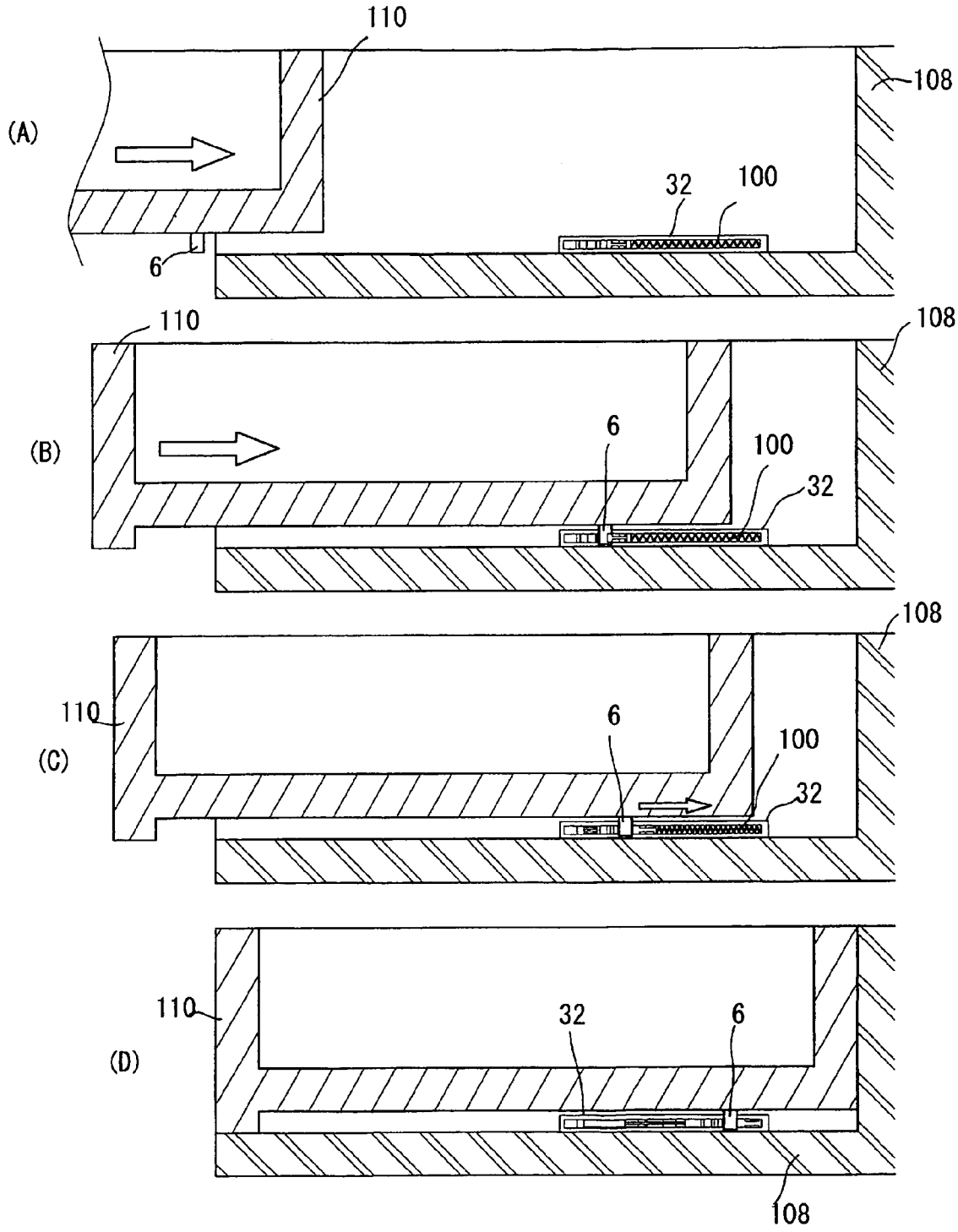
FIG. 13 is an operational graphical view according to the present invention.

As shown by (A) of FIG. 12, in a condition that the drawer 110 is pulled out from the external box 108 and the projection portion 6 is detached from the chuck section 46, the fitting convex portion 44 is located in the locking portion 38*b* of the groove 38 as shown in (A) of FIG. 11, by which the movement member 40 is locked to the intake movement standby position at one end of the movement stroke. In this condition, a tensile strength due to the intake spring 100 affects the movement member 40, which is strongly pulled leftward in FIG. 11 by the foregoing intake spring 100.

In a condition that the fitting convex portion 44 is fitted into the locking portion 38*b* of the groove 38, the movement member 40 is clockwise inclined around the fitting convex portion 42 by a predetermined angle as shown in (A) of FIG. 11, and this inclination causes the emergent-use engagement portion member 52 to be moved downward as shown in (A) of FIG. 11. In addition, in the condition that this movement member 40 is inclined, the portion between the engagement surface of the first engagement portion 48 and the projection portion 6 at the drawer 100 side is opened and the upper end of the second engagement portion 50 and the upper end of the emergent-use engagement member 52 are detached from the movement route of the projection portion 6.

In the above-mentioned condition, when the drawer 100 is inserted into the external box 108 by hand and the drawer 110 is moved to the predetermined position in the arrow's direction in FIG. 12, the projection portion 6 abuts on the first engagement portion 48 of the movement member 40.

Furthermore, if the drawer 110 is moved in the arrow's direction, the movement member 40 is pushed leftward in FIG. 11 by the projection portion 6 and is anti-clockwise rotated around the fitting convex portion 42 as shown in (A) of FIG. 11. This causes the fitting convex portion 44 to be lifted up from the locking portion 38*b* and ride on the linear portion 38*a* of the groove 38 through the curved portion 38*c* of the groove 38 as shown in (B) of FIG. 11. If the movement member 40 is anti-clockwise rotated around the fitting convex portion 42 by the predetermined angle in FIG. 11, the second engagement portion 50 is lifted up. This causes the projection portion 6 to be engaged with the chuck portion 46 between the first and second engagement portions 48 and 50 and placed as shown in (B) of FIG. 11.

If the fitting convex portion 44 is detached from the engagement portion 38*a* of the groove 38 by the pressure force from the projection portion 6, the locking condition to the movement member 40 by the locking portion 38*b* is released, the movement member 40 is moved along the linear portion 38*a* of the groove 38 leftward in FIG. 11 and toward the backside of the external box 108 in the arrow's direction in FIG. 12 by the tensile strength of the intake spring 100. If the movement member 40 is moved leftward in FIG. 11 by the tensile strength of the intake spring 100. the second engagement portion 5 of the movement member 40 is engaged with the projection portion 6 (refer to C of FIG. 11 and C of FIG. 12), and the movement member 40 draws the drawer 110 toward the back side of the external box 108 by the movement force (refer to D of FIG. 11 and D of FIG. 12).

At this time, the movement operation of the movement member 40 by the intake spring 100 is transferred through the flexible member 94 to the pulley 90, which is moved leftward in FIG. 11 along the guide groove 92 while rotating in association with the leftward movement. In association with this movement of the pulley 90, the piston rod 62 of the cylindrical shock absorber 58 is moved linearly toward the back side of the cylinder 60, the braking force by the cylindrical shock absorber 58 affects the leftward movement operation of the movement member 40 in FIG. 11 and the drawer 110 is drawn slowly at a proper seed toward the back side through the projection portion 6 without quick movement by the tensile strength of the intake spring 100. The piston rod 62 is urged rightward in FIG. 11 by the coil spring 78 for recovery, however, the leftward tensile strength by the intake spring 100 in FIG. 11 is designed to be larger than this urging force.

If the drawer 110 is moved to the uppermost back side of the external box 108, as shown in (D) of FIG. 11, in the fitting convex portion 42, the attachment position of the basic substrate 30 to the external box 108 is adjusted in advance as reaching the intake end of the linear portion 38*a* of the groove 38 or the vicinity. The movement stroke along the guide groove 92 of the foregoing pulley 90 in association with the movement along the linear portion 38*a* of the groove 38 of the foregoing movement member 40 becomes half of the movement stroke of the movement member 40 on the basis of principle of the movable pulley, which enables the whole length of the guide groove 92 to be shortened and the basic substrate 30 to be miniaturized.

If the drawer 110 is pulled out outward by hand from the condition inserted into the external box 108, the projection portion 6 is moved rightward from the condition (D) in FIG. 11 with it engaged with the second engagement portion 50 of the movement member 40 and the movement member 40 takes against the tensile strength of the intake spring 100 and is moved rightward along the liner portion 38*a* of the groove 38. If the drawer 110 is pulled out up to the predetermined position by hand, the fitting convex portion 44 is guided by the locking portion 38*b* of the groove 38 and reaches the back side end of the locking portion 38*b*.

At this time, the movement member 40 is inclined clockwise around the fitting convex portion 42 in FIG. 11 and the projection 6 is released from the engagement condition with the second engagement portion 50. This causes the projection portion 6 to interlock with the movement in the drawing direction of the drawer 110, be detached from the chuck portion 46 of the movement member 40 and be moved rightward in FIG. 11. Little braking force is applied to the movement of the movement member 40 linking with the drawer 110 from the cylindrical shock absorber 58. If the movement member 40 is moved rightward, in association with this movement, the pulley 90 is moved rightward along the guide groove 92 due to the springing force of the coil spring 78 of the cylinder 58.

When the foregoing fitting convex portion 44 is fitted into the locking portion 38*b* of the foregoing groove 38, the position of the joint portion between the foregoing intake spring 100 and the movement member 40, that is, the position of the fitting 102 is located slightly lower than the fitting convex portion 44 in the locking portion 38*b*. This lets the intake spring 100 pull leftward the lower portion than the engagement position of the movement member 40 with the locking portion 38*b* to prevent the fitting convex portion 44 from being detached from the locking portion 38*b*.

In addition, in a condition that the drawer 110 is pulled out from the external box 108 as shown in (A) of FIG. 12, the movement member 40 is normally located on the left end of the movement stroke (right end in case of in (A) of FIG. 11) and locked by the locking portion 38 of the groove 38, however, in a condition that the drawer 110 pulled out due to some accident, the movement member 40 can be moved to the right end of the movement stroke (left end in case of FIG. 1).

Figure 14:
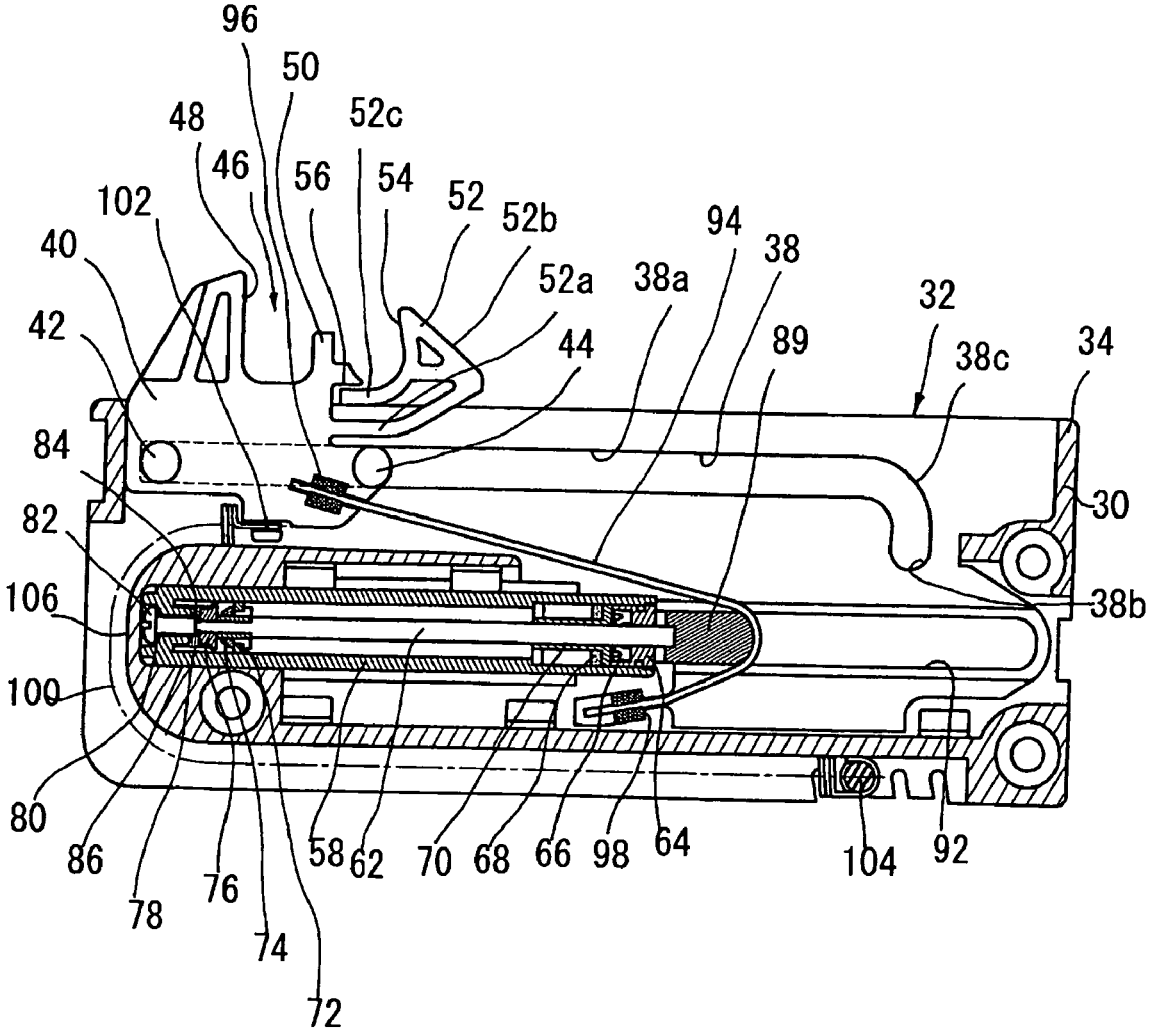
FIG. 14 is an operational graphical view according to the present invention.

In this case, it is necessary to return to the left end as a steady position (right end in case of FIG. 1) as shown in (A) of FIG. 14. The emergent-use engagement member 52 is provided as a remedy. FIG. 14 shows the movement to return the position of the movement member 40 to the steady position.

First, if the drawer 110 is pushed by hand in the closing direction as shown by the arrow's direction in FIG. 14 to let the projection portion 6 collide with the inclined surface 52*b* of the emergent-use engagement member 52 (refer to (B) of FIG. 14), furthermore is pushed toward the back side as shown in (C) of FIG. 14, the engagement member 52 takes against the spring force of the spring portion 52*a* (refer to FIG. 1) and is pushed in the pulling direction from the basic substrate 30, that is, in the lower direction in FIG. 1 by the projection portion 6.

After the projection portion 6 climbs over the inclined surface 52*b*, the emergent-use engagement-use engagement member 52 is recovered to the original position by the spring force of the spring portion 52*a*, the projection portion 6 is fitted into the section between the 3rd engagement portion 54 and the second engagement portion 50 and the projection portion 6 is chucked between the engagement portions 54 and 50 (refer to (C) of FIG. 14). Next, if the drawer 110 is pulled by hand as shown in (D) of FIG. 14, the leftward movement is transferred to the movement member 40 through the 3rd engagement portion 54, the movement member 40 is moved leftward together with the drawer 110 along the groove 38, the fitting convex portion 44 is fitted into the locking portion 38*b* of the groove 38 and the movement member 40 is returned to the steady position and locked to the foregoing position.

While the movement member 40 is returned to the steady position, the 3rd engagement portion 54 receives the pressure at the right side from the projection portion 6 in FIG. 1 and the spring 52*a* is bent by this pressure and the engagement member 52 is inclined to slightly lift up the a projected piece 52*c* for locking, however, the lift-up displacement of this projected piece 52*c* for locking is locked by the stopper 56 formed in the movement member 40.

For this reason, the engagement member 52 is not greatly inclined by the pressure from the projection portion 6 and the projection portion 6 is not detached from the 3rd engagement portion 54 of the engagement member 52.

According to the above-mentioned embodiments, the linear portion 38*a* of the foregoing groove 38 and the fitting convex portions 42, 44 fitted into them, comprise a movement member guide mechanism to linearly and movably guide the foregoing movement member 40 along the foregoing basic substrate 30 within the predetermined stroke. In addition, the fitting convex portion 44 which is protruded by the foregoing movement member 40 and is slidably fitted to the groove 38, the first engagement portion 48 formed in the foregoing movement member 40, and the locking portion 38*b* perpendicularly formed in the foregoing groove 38 comprise a locking means designed to let the movement of the foregoing movement member 40 releasably locked to the movement end in the movement direction of the movement member 40 taking against the urging force of the urging means. In addition, various compositions can be employed as these locking means but not limited to the composition shown in the present embodiments in particular.

What is claimed is:

1. An intake unit engaging with a projection portion of a drawing device to move a drawer in the predetermined direction comprising:

a basic substrate;

a cylindrical shock absorber having a structure of applying a braking force to a telescopic relative movement between a cylinder and a piston rod, one end of which is a movable side and other end is a fixed side, the cylindrical shock absorber being attached to said basic substrate on the fixed side and being provided with a guide portion for a flexible member on said movable side;

a movement member;

a movement member guide mechanism provided to said basic substrate for movably and linearly guiding said movement member along said basic substrate within a scope of predetermined stroke;

an urging means provided on said basic substrate for urging said movement member in one direction;

a first engagement portion provided in said movement member for engaging with said projection portion when said projection portion moves relatively to said movement member in one direction;

a second engagement portion provided in said movement member for engaging said projection portion when said projection portion moves relatively to said movement member in the other direction;

a locking means which releasably locks movement of said movement member at the end of movement of said movement member resisting an urging force of said urging means and which releases this lock by pressure due to one direction relative movement of said projection portion with respect to said first engagement portion; and a flexible member in which a middle portion thereof is suspended to a guide portion on the movement side of said shock absorber and one end is connected to said movement member and the other end is connected to said basic substrate;

wherein, when said movement member is released from the lock state, said movement member moves by predetermined stroke in one direction due to urging force of said urging means, and against this movement, a braking force of said cylindrical shock absorber is applied through said flexible member.

2. The intake unit according to claim 1 wherein the guide mechanism provided in said shock absorber on the movement side is a pulley.

3. The intake unit according to claim 1 wherein the guide mechanism provided in said shock absorber on the movement side is a convex portion fixed on said movement side.

4. The intake unit according to claim 1 wherein said urging means is a coil spring which is connected to said movement member at one end thereof and connected to said basic substrate at the other end thereof, and which changes direction by a direction change mechanism in the middle thereof.

5. The intake unit according to claim 1 wherein said cylindrical shock absorber comprises an initial position returning means pushing the piston rod outward from the cylinder.

6. The intake unit according to claim 5 including said cylindrical shock absorber which comprises: a cylinder filled with oil; a piston formed with a bore for passing through the oil substantially without resistance; a piston rod connected to said piston; a valve opening said bore when said piston moves in one direction inside said cylinder and closing said bore when said piston moves in other direction; and a coil spring disposed between a back end of said cylinder and a spring receiver attached to said piston rod, wherein said coil spring comprises an initial position returning means pushing the piston rod outward from the cylinder.

* * * * *